US006595582B1

(12) United States Patent
Liu

(10) Patent No.: US 6,595,582 B1
(45) Date of Patent: Jul. 22, 2003

(54) FOLDING CHAIR WITH SAFETY LATCH DEVICE

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 10/040,354

(22) Filed: Jan. 9, 2002

(51) Int. Cl.[7] ..... A47C 3/02

(52) U.S. Cl. ..... 297/35; 297/16.1; 297/39; 297/36; 297/52; 297/463.1; 297/463.2; 16/231; 292/266; 292/273; 292/277

(58) Field of Search ..... 297/16.1, 35, 39, 297/46, 52, 463.1, 463.2; 16/231; 292/266, 273, 277

(56) References Cited

U.S. PATENT DOCUMENTS 5,054,848 A * 10/1991 Liu
5,735,570 A * 4/1998 Tseng
5,964,500 A * 10/1999 Lin
6,095,596 A * 8/2000 Chen
6,206,462 B1 * 3/2001 Huang
6,217,111 B1 * 4/2001 Tseng

* cited by examiner

*Primary Examiner*—Milton Nelson, Jr.
(74) *Attorney, Agent, or Firm*—Bacon & Thomas, PLLC

(57) ABSTRACT

A folding chair with safety latch device. The device includes an anchor unit which has two ends pivotally engaged with a rear leg and a backrest bracket, and a slide unit coupled with the rear leg. The anchor unit and the slide unit have respectively a latch finger and a latch opening corresponding to with each other to form a latched relationship. The slide unit further has a release opening to allow users to undo the latched relationship only through a tool such that a child sitting on the chair may be prevented from falling down resulting from abrupt folding of the chair caused by incidental release of the latched relationship.

9 Claims, 6 Drawing Sheets

FOLDING CHAIR WITH SAFETY LATCH DEVICE

FIELD OF THE INVENTION

The present invention relates to a safety latch device for a folding chair adapted for use by children and particularly to a latch device for a folding chair that can prevent latch means from unfastening when a child is seated on the chair to avoid accidental folding of the chair.

BACKGROUND OF THE INVENTION

Folding chairs are chairs with turnable and foldable frames adapted to compact the size of the chairs for storage. They may be folded when not in use to reduce storage space, and may be unfolded for use when desired.

However, the turning and folding function of such folding chairs can cause the chairs to tumble accidentally due to unbalanced loading during use. Hence safety and stability have become very important issues for folding chairs. This is especially true for folding chairs designed for use by children. As children are usually very active, guarding mechanisms and measures for folding chairs should be more thorough and comprehensive.

In the known prior art, the main structure of a folding chair generally includes a seat bracket, backrest bracket, and front and rear legs that can perform relative and pivotal turning and folding movements. Such a prior art chair includes a latch device located between the rear legs and backrest bracket. In order to prevent children from injury, applicant has disclosed a design in U.S. Pat. No. 5,054,848, granted Oct. 8, 1991, entitled: "Folding Chair Frame Tube Position Device". Its structure includes a slide unit coupled to the rear leg and a positioning element having two ends pivotally and respectively engaged with the rear leg and backrest bracket. The slide unit and the positioning element have respectively a harness trough and a harness section located at corresponding positions to engage with each other. When the folding chair is extended, the slide unit may be moved downwards to contact the positioning element, and the harness trough and the harness section may form a latched condition to make the folding chair steady in the extended condition without abrupt tumbling or folding.

However, such a folding chair still has potential risks when seating a child. As any child can easily move the slide unit away from the positioning element to disengage the harness section from the harness trough, and as a result, the folding chair can become loosened and unfastened. A slight movement of a person sifting on such chair could cause the seat bracket, backrest bracket and front and rear legs to turn and fold because of unbalanced loading and cause accidents.

SUMMARY OF THE INVENTION

The primary object of the invention is to resolve aforesaid disadvantages. The invention aims to provide a safety latch device for a folding chair that will not be unfastened easily under the latched condition to prevent a child sitting thereon from falling down.

To achieve the foregoing objects, the safety latch device of the invention mainly includes an anchor unit and a slide unit. The anchor unit has two ends pivotally engaging with the rear leg and the backrest bracket. The pivotal end on the backrest bracket has a harness section to allow the folding chair extending and positioning. The harness section has an extended latch finger. The slide unit is coupled to the rear leg and has a harness trough corresponding to and engageable with the harness section. The harness trough has a latch opening to allow the latch finger passing to form a latched relationship. On the exterior of the slide unit, there is a release opening for releasing the latched relationship between the latch finger and latch opening mentioned above. Hence the chair may be prevented from incidental tumbling and hurting the child sitting thereon.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
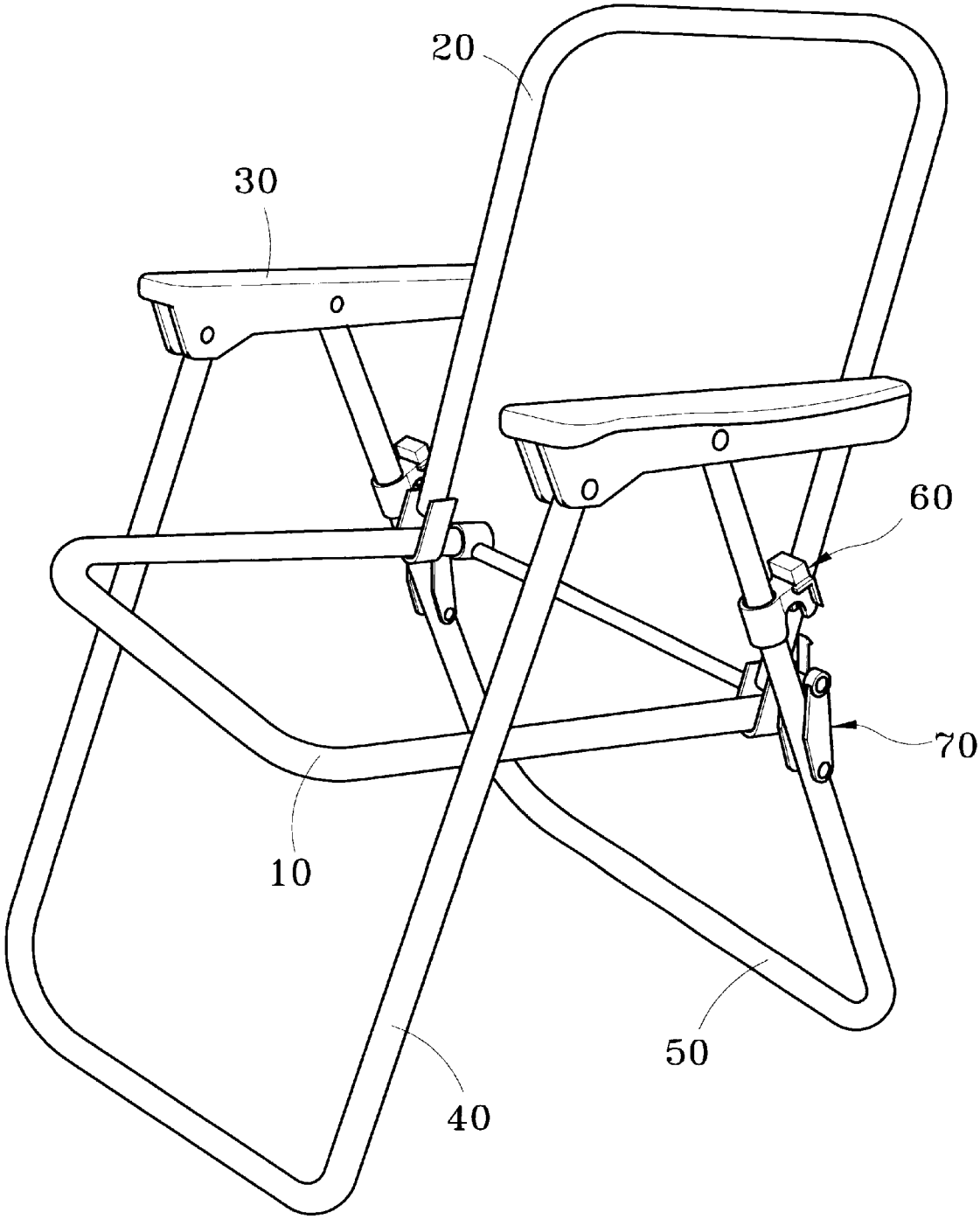
FIG. 1 is a perspective view of an embodiment of the invention.
Figure 2:
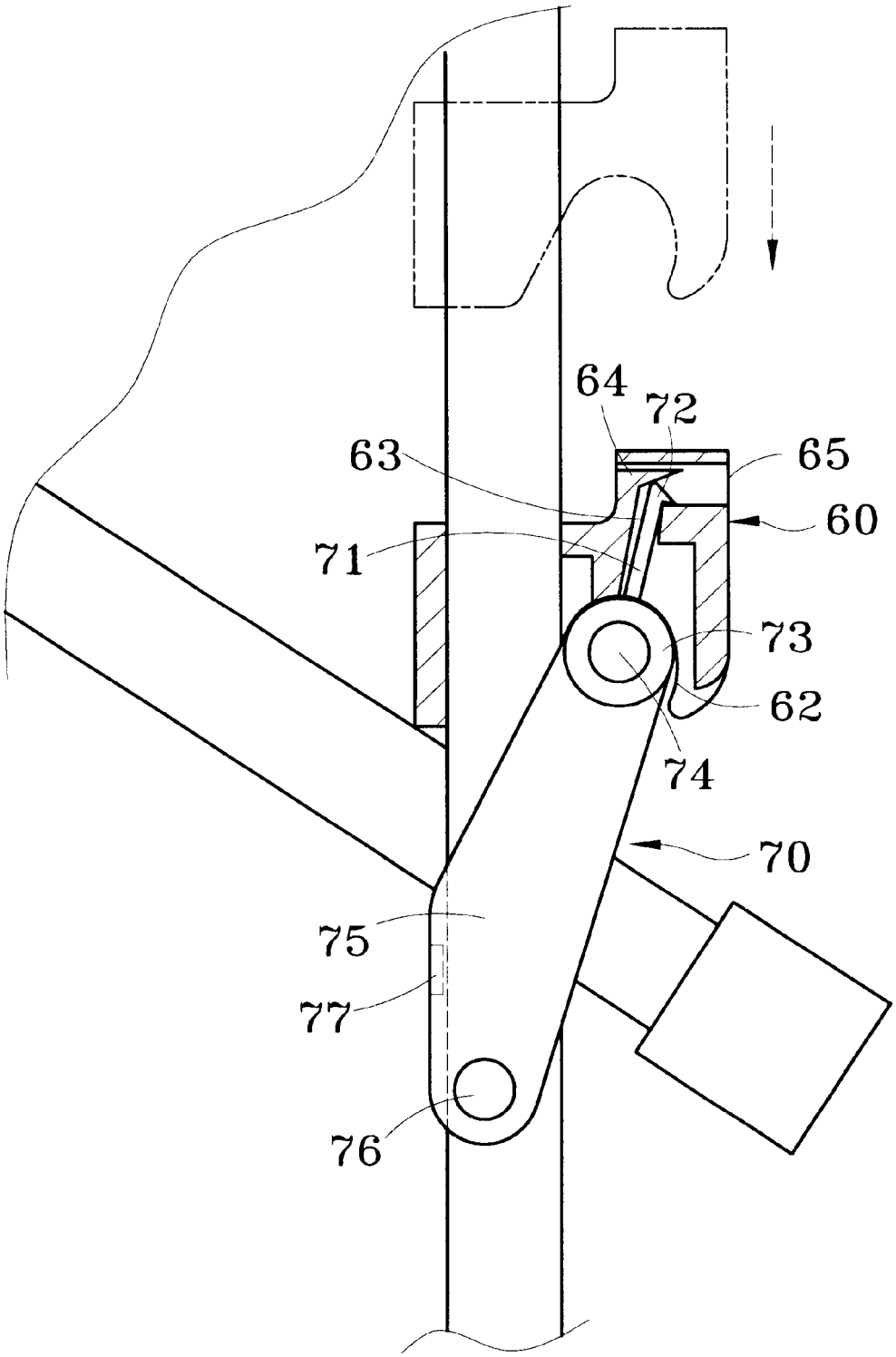
FIG. 2 is a schematic view of the safety latch device of the invention shown partially in section.

Referring to FIGS. 1 and 2, for an embodiment of the invention, the folding chair on which the safety latch device of the invention is installed includes a seat bracket 10, a backrest bracket 20, and two front legs 40 and two rear legs 50 pivotally engaged with two sides of the seat bracket 10. The elements set forth above form a turnable and foldable relationship among one another. The invention mainly includes an anchor unit 70 which has two ends respectively and pivotally engaging with the rear leg 50 and backrest bracket 20, and a slide unit 60 slidably coupled to the rear leg 50. The pivotal end of the anchor unit 70 on the backrest bracket 20 has a harness section 73 for the folding chair to extend and be in position. The harness section 73 has an extended and elastic latch finger 71. The slide unit 60 may be slid on the rear leg 50 and has a harness trough 62 corresponding to and engageable with the harness section 73. The harness trough 62 has a latch opening 63 allowing the latch finger 71 to insert thereinto to form a latched relationship therebetween. The slide unit 60 further has a release opening 65 formed on the exterior thereof for releasing the latched relationship set forth above. Users must utilize a tool to insert into the release opening 65 to disengage the latched relationship between the latch finger 71 and the latch opening 63. Thereby the chair with a child sitting thereon may be prevented from abrupt folding because of accidental unfastening of the latch.

The anchor unit 70 has two ends formed respectively a first axis section 74 and a second axis section 76 for pivotally engaging with the backrest bracket 20 and the rear leg 50. The first and second axis sections 74, 76 have at least one swiveling side wing 75 which has an anchor element 77 corresponding to a folding displacement location of the rear leg 50 to aid in the positioning of the rear leg 50. The latch finger 71 and the anchor unit 70 may be integrally formed. The latch finger 71 has a top end formed as an inverse hook 72.

The slide unit 60 has two sides each having a reinforced section 66 to strengthen the structure of the harness trough 62 so that the harness trough 62 and the harness section 73 may be engaged more securely. In the latch opening 63 of the slide unit 60, there is an elastic retain flange 64 for pressing the latch finger 71 to prevent the latch finger 71 from breaking loose.

Figure 3A:
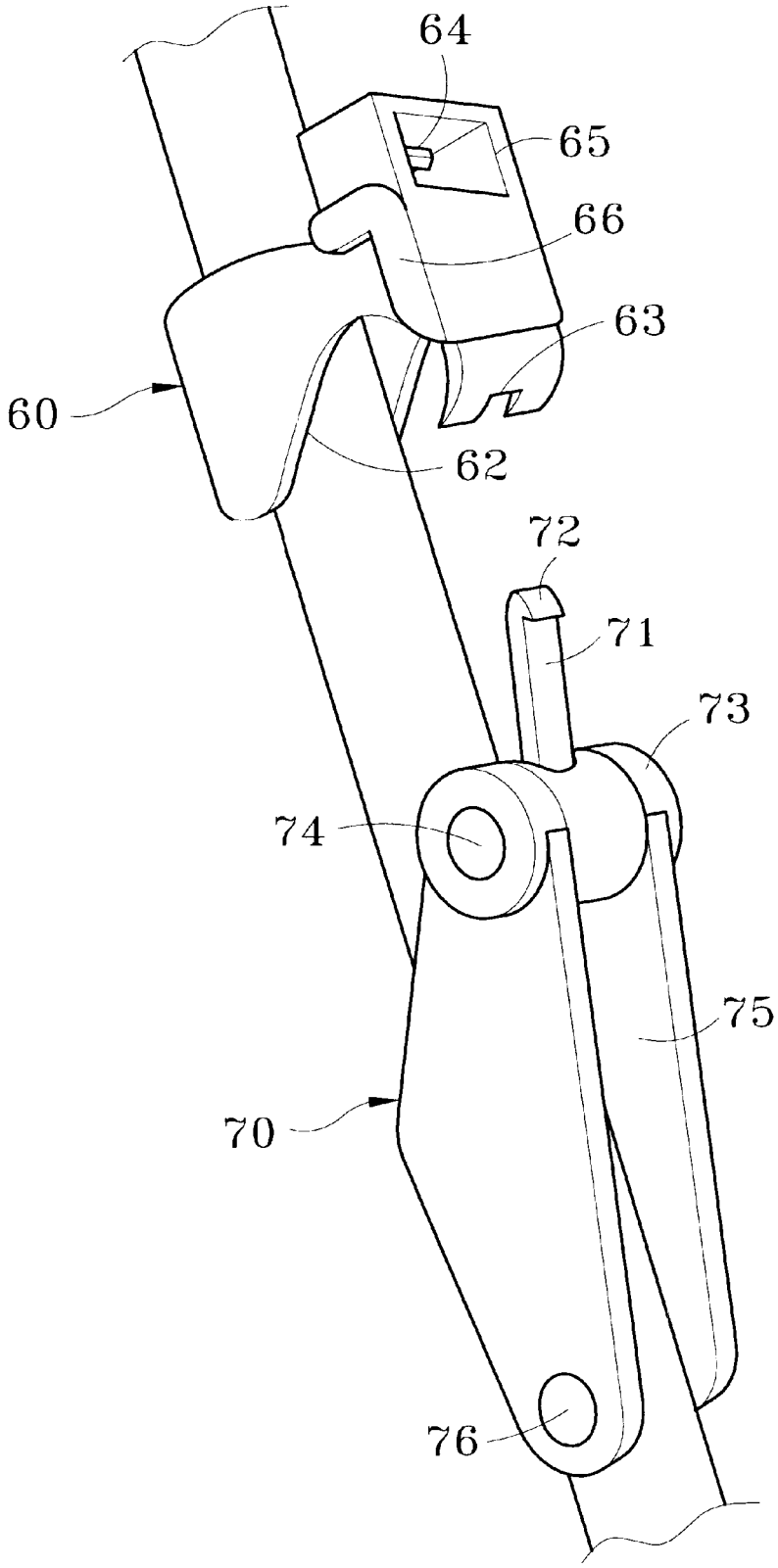
FIGS. 3A and 3B are schematic views of the safety latch device of the invention in use.
Figure 3B:
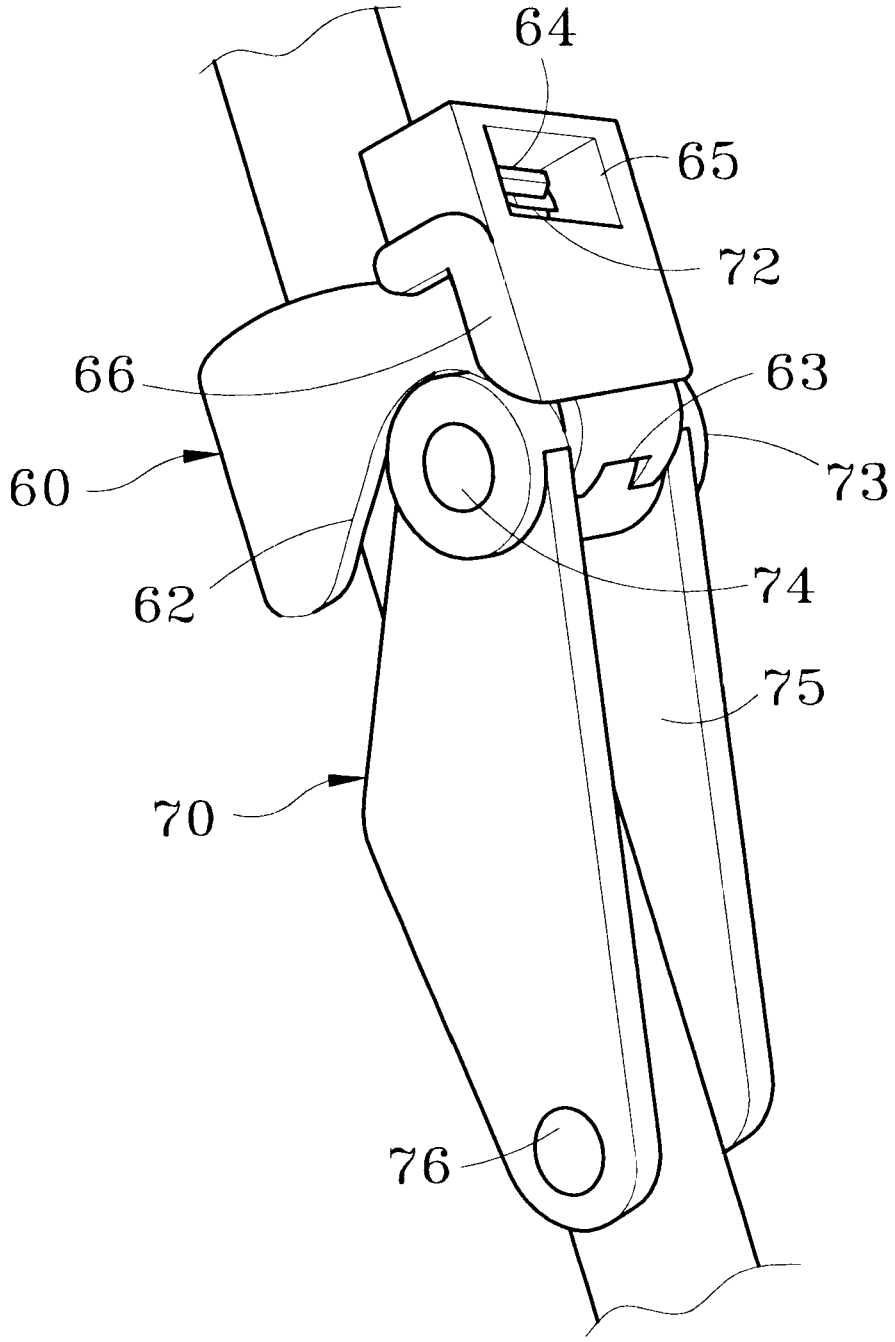

Referring to FIGS. 3A and 3B, when in use, the anchor unit 70 may be swiveled about the second axis section 76 through the side wing 75 to allow the harness section 73 located on the outer rim of the first axis section 74 resting on the rear leg 50. Then the slide unit 60 and the anchor unit 70 are on a same linear line. Users may direct the harness trough 62 of the slide unit 60 towards the harness section 73 of the anchor unit 70, and move the slide unit 60 to the anchor unit 70 to make the harness section 73 latch the harness trough 62. In the mean time, the latch finger 71 of the harness section 73 is inserted into the latch opening 63, and is depressed by the retain flange 64 in the harness opening 63. And the inverse hook 72 on the top end of the latch finger 71 is latched in the release opening 65 to form a latched relationship. By means of aforesaid construction, the slide unit 60 cannot be separated easily from the anchor unit 70, and therefore can prevent the chair from accidental folding, and prevent a child sitting on the chair from falling. When it is desired to undo the latched relationship, a thin tool (not shown) with a pointed front end must be used to insert into the release opening 65 to move the inverse hook 72 of the latch finger 71 away from the latch opening 63.

Figure 4A:
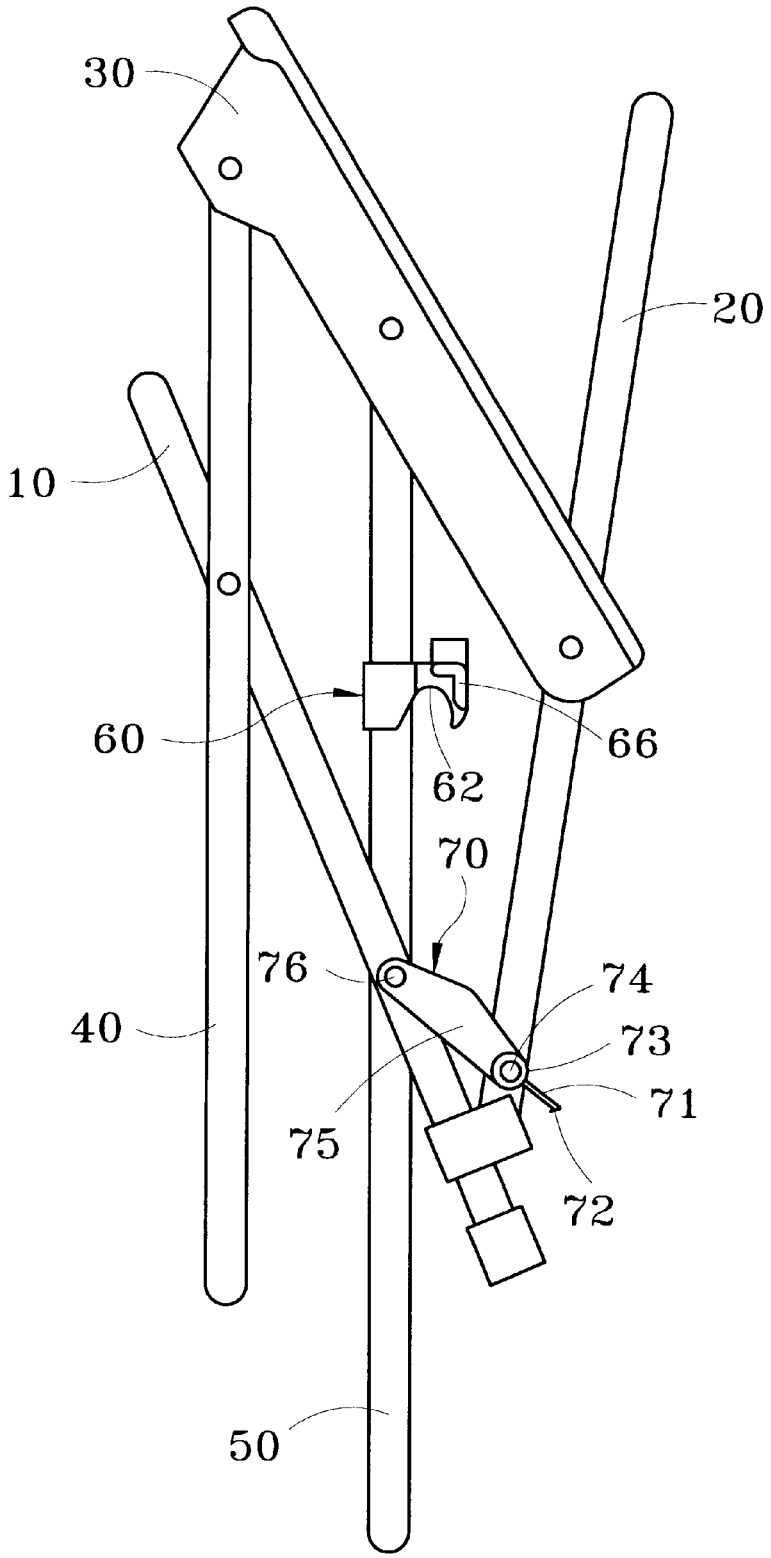
FIGS. 4A and 4B are schematic views of an embodiment of the invention in use.
Figure 4B:
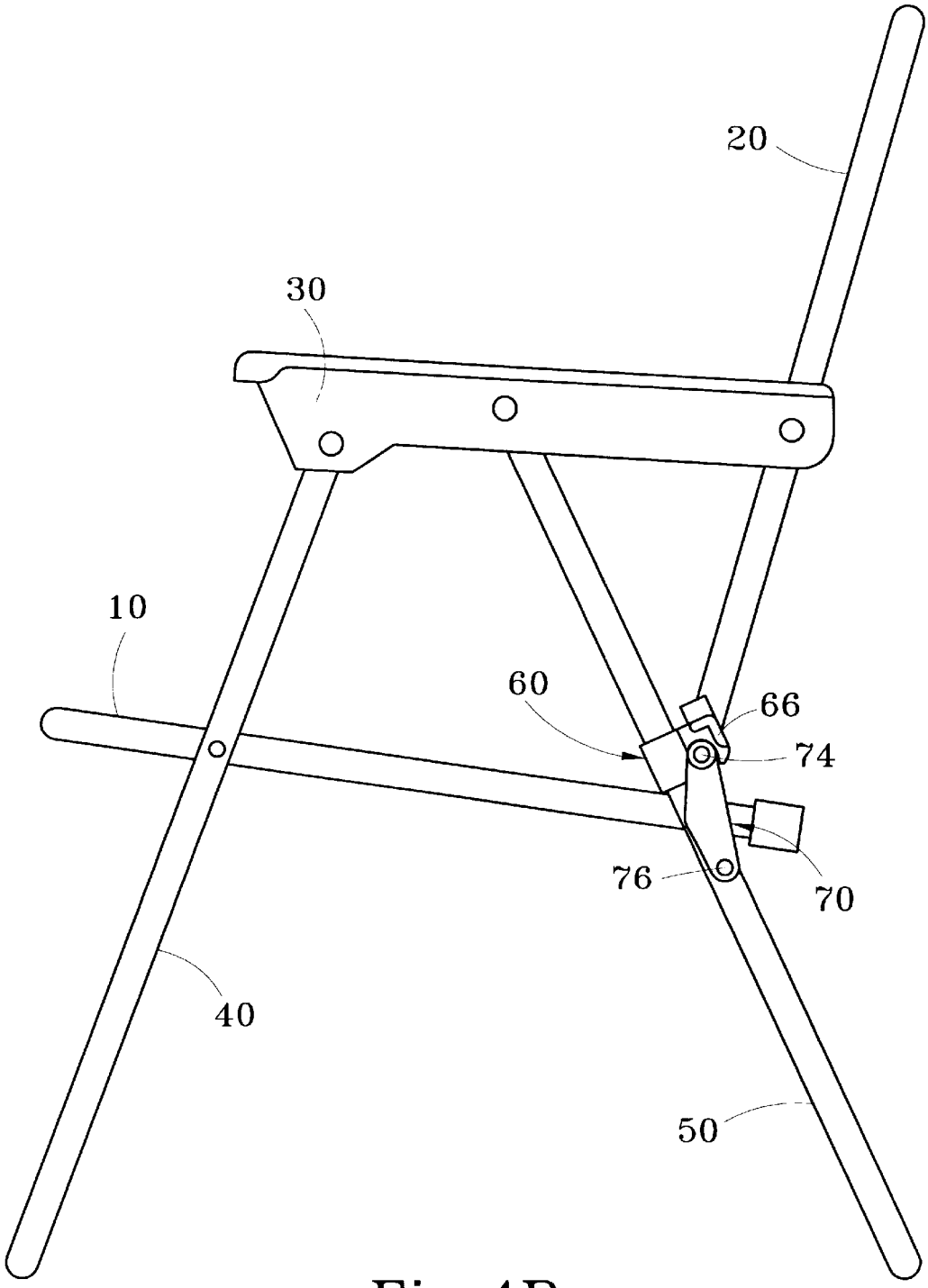

Referring to FIGS. 4A and 4B for an embodiment of the invention, the folding chair mainly includes a seat bracket 10 and a backrest bracket 20, and with two front legs 40, two rear legs 50 and two armrests 30 pivotally engaged with two sides of the seat bracket 10. The elements set forth above form a rotatable and foldable relationship among the elements. After applying forces on the front and rear legs 40, 50 to extend the folding chair, the anchor unit 70 may be swiveled about the second axis section 76 through the side wing 75, and the rear leg 50 is driven to move close to the backrest bracket 20. In the mean time, the first axis section 74 is moved and rested on the rear leg 50 and is located on a same linear line with the slide unit 60. Applying a force on the slide unit 60, the slide unit 60 may be moved towards the anchor unit 70 to make the latch opening 63 in the harness trough 62 to latch on the latch finger 71 of the harness section 73. Thereby, the chair may be positioned and anchored in an extended condition without folding or swiveling. When a user sits on the chair, the load exerting on the seat bracket 10 and backrest bracket 20 is distributed through the anchor unit 70 to the rear legs 50. The anchor unit 70 can be securely fastened without loosening easily to protect the safety of the child sitting on the chair. Only by using a pointed article to insert into the release opening 65 to move the latch finger 71 away from the latch opening 63 can the chair be folded and stored.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A folding chair with a safety latch device, comprising:

an anchor unit having two ends pivotally engaged with a rear leg and a backrest bracket, a pivotal engaging end on the backrest bracket having a harness section which has an extended latch finger;

a slide unit slidably coupled with the rear leg having a harness trough corresponding to and engageable with the harness section, the harness trough having a latch opening configured to allow the latch finger to insert therein to form a latched relationship therebetween, the slide unit further having an exterior with a release opening formed therein configured for releasing the latched relationship; and wherein the latched relationship between the latch finger and the latch opening is releasable by inserting a tool into the release opening to prevent the latched relationship from becoming accidentally released and resulting in abrupt folding of the folding chair and causing injury to a user sitting on the chair.

2. The folding chair of claim 1, wherein the anchor unit has at least one swivel side wing pivotally engaged with the backrest bracket and the rear leg.

3. The folding chair of claim 2, wherein the swivel side wing has an anchor element corresponding to a folding displacement location of the rear leg to aid positioning of the rear leg.

4. The folding chair of claim 1, wherein the latch opening has a retain flange located therein to prevent the latch finger from breaking loose.

5. The folding chair of claim 4, wherein the retain flange is elastic.

6. The folding chair of claim 1, wherein the latch finger and the anchor unit are integrally formed.

7. The folding chair of claim 1, wherein the latch finger is elastic.

8. The folding chair of claim 1, wherein the latch finger comprises a hook at an open end thereof.

9. The folding chair of claim 1, wherein the slide unit has two sides each having a reinforced section adapted to reinforce the harness trough.

* * * * *